United States Patent [19]

Grantom

[11] Patent Number: 5,033,551

[45] Date of Patent: Jul. 23, 1991

[54] WELL PACKER AND METHOD

[76] Inventor: Charles A. Grantom, 2712 Frank Rd., Houston, Tex. 77032

[21] Appl. No.: 529,114

[22] Filed: May 25, 1990

[51] Int. Cl.[5] ..... E21B 23/06; E21B 33/126

[52] U.S. Cl. ..... 166/387; 166/74; 166/181; 166/202; 166/242

[58] Field of Search ..... 166/387, 202, 179, 205, 166/74, 143, 144, 181, 242; 175/314

[56] References Cited

U.S. PATENT DOCUMENTS

| | | | |
|---|---|---|---|
| 411,886 | 10/1889 | Clark | 166/202 X |
| 1,042,425 | 10/1912 | Galbraith | 166/144 |
| 1,336,738 | 4/1920 | Fletcher | 166/179 X |
| 1,403,359 | 1/1927 | Turpin, Jr. . | |
| 1,564,699 | 12/1925 | McCartney | 166/144 |
| 2,275,936 | 3/1942 | Baker | 166/202 X |
| 2,325,556 | 7/1943 | Taylor et al. | 166/202 |
| 2,357,145 | 8/1944 | Standefer | 166/202 X |
| 2,460,561 | 2/1949 | Winkelmann | 166/202 X |
| 2,618,345 | 11/1952 | Tucker | 166/202 X |
| 2,723,721 | 11/1955 | Corsette | 166/179 |
| 2,736,584 | 2/1956 | Reising | 288/11 |
| 2,736,586 | 2/1956 | Reising | 288/11 |
| 2,781,852 | 2/1957 | Rumble | 166/196 X |
| 3,118,682 | 1/1964 | Fredd | 277/170 |
| 3,287,920 | 11/1966 | Oitto, Jr. | 166/202 |
| 3,428,128 | 2/1969 | Jones | 166/202 X |
| 3,431,974 | 3/1969 | Buck et al. | 166/202 X |
| 3,568,773 | 3/1971 | Chancellor et al. | 166/202 X |
| 4,114,898 | 9/1978 | Bainard et al. | 277/9 |
| 4,403,660 | 9/1983 | Coone | 166/387 |
| 4,424,865 | 1/1984 | Payton, Jr. | 166/302 |
| 4,428,592 | 1/1984 | Shaffer | 277/230 |
| 4,443,017 | 4/1984 | Knott | 277/152 |
| 4,482,013 | 11/1984 | Fulkerson | 166/202 X |
| 4,500,095 | 2/1985 | Schisler et al. | 277/34 |
| 4,516,782 | 5/1985 | Usher | 277/1 |
| 4,559,249 | 12/1985 | Arigaya et al. | 428/36 |
| 4,601,476 | 7/1986 | Usher et al. | 277/230 |
| 4,614,346 | 9/1986 | Ito | 277/34 |
| 4,796,706 | 1/1989 | Townsend et al. | 166/181 X |
| 4,930,577 | 6/1990 | Grantom | 166/387 |

FOREIGN PATENT DOCUMENTS

| | | | |
|---|---|---|---|
| 829868 | 5/1981 | U.S.S.R. | 166/179 |

OTHER PUBLICATIONS

West Well Screen Co.-3 pp.

The BP Seal Company Publication-2 sides on one page.

*Primary Examiner*—Hoang C. Dang

*Attorney, Agent, or Firm*—Pravel, Gambrell, Hewitt, Kimball & Krieger

[57] ABSTRACT

A method and apparatus for sealing a well annulus, the apparatus comprising a resilient sealing element molded in a upwardly oriented frustro-conical form affixed to a packer body. A running tool is mated with the packer body, the running tool having an internal bore adapted to collapse the sealing element to the diameter of the internal bore. The packer body is mated with a tubing screen by right hand threads and the running tool, packer body and tubing screen lowered into a well casing at the end of a pipe string. The well seal is activated when the pipe string is rotated in a clock-wise direction, disengaging and withdrawing the running tool and releasing the skirt which expands to seal with the internal walls of the casing.

6 Claims, 2 Drawing Sheets

FIG. 4
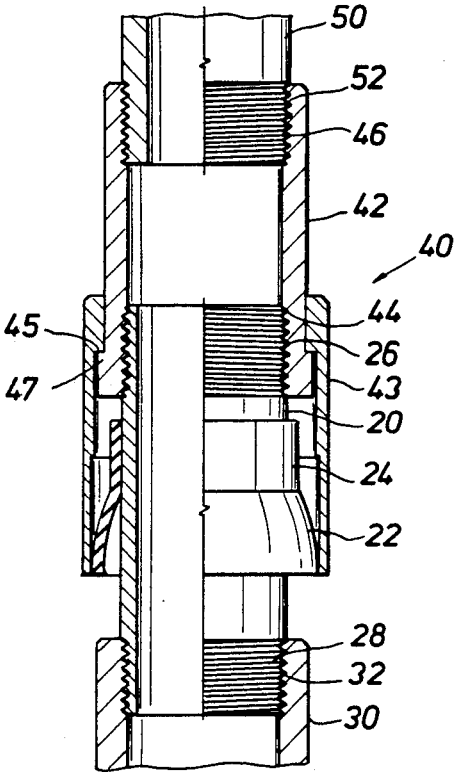
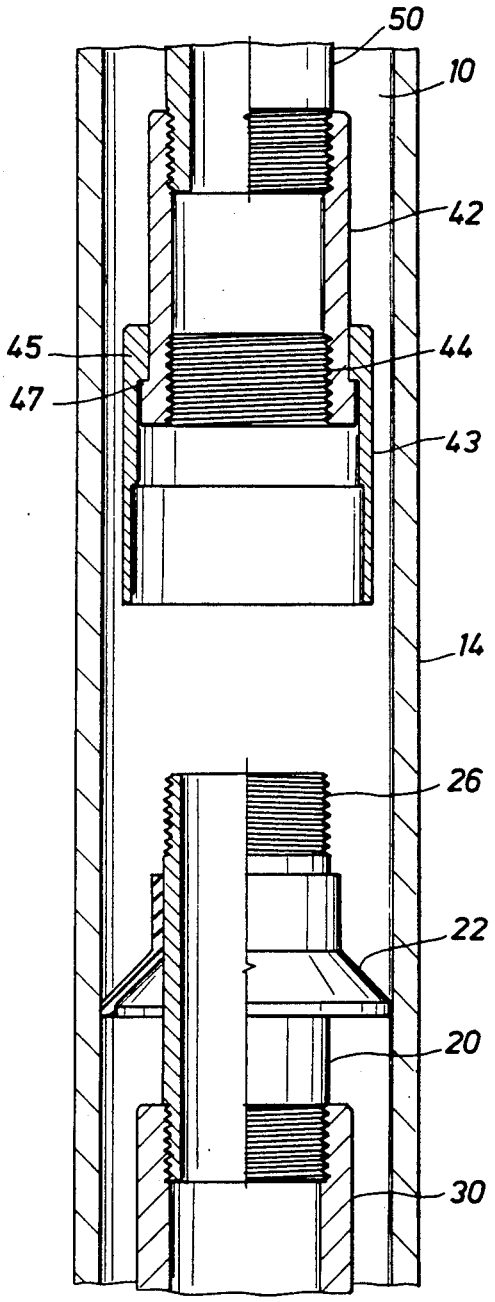
FIG. 5
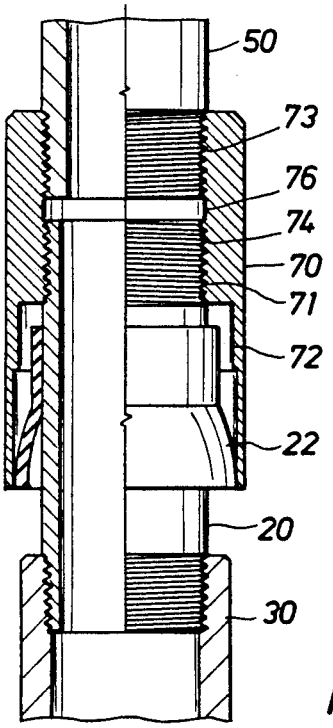
FIG. 6

WELL PACKER AND METHOD

FIELD OF THE INVENTION

The present invention relates to the field of well packers and methods for sealing the well packers downhole, particularly, to seal an annulus between a casing or open hole and a tubing member.

BACKGROUND OF THE INVENTION

The present invention is designed for use in a well environment. A hole is drilled to the depth of a water or hydrocarbon bearing strata and a casing lowered into the well bore. The casing is cemented into place within the well bore using conventional cementing techniques. A perforating gun of the type generally known in the industry is lowered into the casing to the depth of the strata and is discharged to create a passageway through the casing and cement into the strata. Water or hydrocarbons flow into the casing through the perforations in the cement and the casing. The water or hydrocarbons will usually carry particulate matter with it as it enters the casing. In order to screen out the particulate matter, a tubing "screen" and a well seal are mounted on the end of a pipe string and lowered into the casing to the depth of the strata.

The well is generally flushed to remove contaminates such as drilling fluids or cuttings from the well bore. The well may be flushed by running a flush pipe through the drill pipe and into the tubing screen and forcing running water or compressed air through the pipe. The drilling fluid and other contaminates are forced to the surface by the water or air via the annulus between the drill pipe and the inner wall of the casing. Upon completion of the flushing operations, the annulus to the surface is closed off by setting the well seal. The well seal is set and the pipe string removed, leaving the tubing screen and packer in the well. A tool to activate the well seal is lowered into the well at the end of a pipe string. This process of removing the pipe string or reinserting the pipe string is known as "tripping." The tripping of a well can require several hours and results in increased costs during drilling operations. Upon activation of the well seal, the pipe string is tripped out of the hole and a production tubing string is lowered into the well to mate with the tubing screen. As with shallower wells, the water may reach the surface as a result of hydrological pressure or may be assisted by pump means. The seal operates to assure all water reaching the surface passes through the tubing screen by sealing off the annulus to the surface.

There are a number of different methods known for sealing the annulus. One of the most common is known as the "lead seal" similar to those described in U.S. Pat. Nos. 411,886 and 1,336,738, and in a publication by Western Well Screen Co.. This type of seal includes a deformable soft metal collar which is threaded onto the end of the tubing screen. The tubing screen and the seal are then lowered into the casing at the end of a pipe string. The well is then flushed in the manner described above. The pipe string is then retrieved leaving the tubing screen and seal in the casing at the depth of the water bearing strata. A tapered sealing iron is then lowered at the end of a pipe string and inserted into the seal. The weight of the pipe string deforms the soft metal collar such that the collar comes into contact with the inner wall of the casing, thus sealing the annulus. However, there are a number of disadvantages to this type of seal. Primary among them is the danger of potable water metal contamination from the soft metal seal which is often made of lead. Second, the deformed metal seal often fails to completely seal the annulus, permitting unfiltered water to rise to the surface via the annulus, carrying particulate matter with it. Lastly, this type of seal requires that the flaring tool be lowered on the end of a pipe string requiring additional trips in the well and resulting in additional cost.

A variation on this type of seal is a non-lead seal as disclosed in a publication by the BP Seal Co. of Houston, Tex. The publication discloses a wire screen encased in an elastomeric material. As with lead seals, the seal and tubing screen are lowered in the well at the end of a pipe string. The screen and seal are released and the pipe string retracted. A flaring tool is then lowered at the end of a pipe string to deform the seal such that the elastomeric material comes into contact with the inner wall of the casing sealing the annulus. Unlike the lead seal, the seal is achieved between the elastomeric material and the casing wall. The screen within the elastomeric material is deformed to hold the elastomeric material in place. However, like the lead seal, this type of seal requires an additional trip down well with a flaring tool.

Another known means of sealing the well annulus includes the use of deformable resilient skirts which seal against the inside wall of the casing. These seals are generally activated by a tool which is lowered into the well bore to activate the seal following flushing operations. This type of seal also requires the tripping of a pipe string to activate the well seal, thus increasing the time and cost required to complete the well.

The above prior devices required that the tubing screen be lowered on a pipe string. A pipe string carrying a tool to actuate the well seal was also required in the above devices. Finally, a production string was lowered and connected to the tubing screen to bring the well into production. It will be appreciated that the time and effort involved in making the multiple "trips" into the well could greatly increase the cost and time required to bring a water well into production.

Yet another method for sealing the annulus in a well bore is disclosed in U.S. patent application No. 348,207, filed May 5, 1989, now U.S. Pat. No. 4,930,577. The inventive entity and the owner of application Ser. No. 348,207 are the same entity and owner in this application. Application Ser. No. 348,207 discloses an elastomeric sealing member which is sealed against a well casing by split rings which expand from a compressed position upon the release of a tubing screen and seal body from a drill pipe. Thus, application Ser. No. 348,207 discloses a non-metallic sealing member which may be activated upon installation without the requirement of an additional trip to activate the seal. However, the hydrostatic forces in the well bore would tend to move the sealing member out of contact with the casing.

SUMMARY OF PRESENT INVENTION

The present invention is directed toward a low cost, recoverable apparatus for sealing the annular space between a tubing member and well bore. Further, the method of the present invention is designed to decrease the number of times that a well must be tripped in order to bring it into production and provides for the recovery of the apparatus.

The present invention is comprised of a cylindrical packer body adapted to be connected to a tubing screen. Affixed to the packer body is a downwardly flaring elastomeric seal element. The upper end of the packer body is releasably connected to the lower end of a running tool having a first and second position. In its first position, the running tool slides over the seal means, collapsing the seal element to permit lowering the packer body and seal element into a well. In its second position, the running tool is retracted freeing the seal element to expand and seal against the well casing. Further, fluid pressure within the well bore acts to further expand the seal element, thereby improving contact between the seal and casing. The running tool may then be disconnected from the packer body, leaving the tubing screen and seal in the well bore for further completion operations.

The method of the present invention calls for the packer body, seal and running tool to be lowered into a well bore at the end of a pipe string with the running tool in its first position. When the tubing screen and seal have been lowered to the desired depth, the pipe string is rotated clockwise, disengaging the running tool from the packer body and moving the running tool to its second retracted position, thereby freeing the seal element. The running tool and pipe string are withdrawn and a production tubing string is releasably connected to the tubing screen.

The present invention thus does away with the hazard posed by deformable metal seals through the use of an elastomeric material. Further, well bore fluid pressure operates to improve the quality seal contact between the seal element and the casing. The present invention also minimizes the number of trips required to install and activate the seal. Thus the present invention decreases the time and consequently the expense associated with bringing a well into production.

BRIEF DESCRIPTION OF THE DRAWINGS

The objects, advantages and features of the invention will become more apparent by reference to the drawings which are appended hereto and wherein like numerals include like parts and wherein an illustrative embodiment of the invention is shown, of which:

FIG. 4 is an enlarged cross-sectional view of the present invention showing the packer body, elastomeric skirt and a two-piece running tool.

FIG. 5 is an enlarged cross-sectional view of the two piece running tool being withdrawn from the packer body and tubing screen, permitting expansion of the elastomeric skirt.

FIG. 6 is an enlarged cross-sectional view of an alternate embodiment the present invention utilizing a one piece running tool.

DETAILED DESCRIPTION OF THE PREFERRED EMBODIMENT

Figure 1:
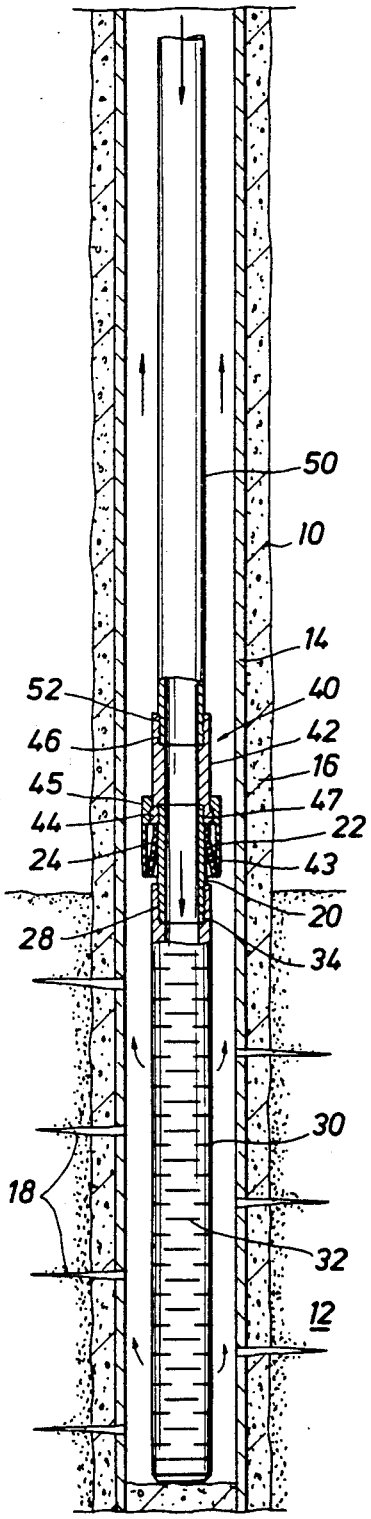
FIG. 1 is an elevational view of the present invention with the running tool, packer body and tubing screen in place at the bottom of the well during flushing operations.
Figure 2:
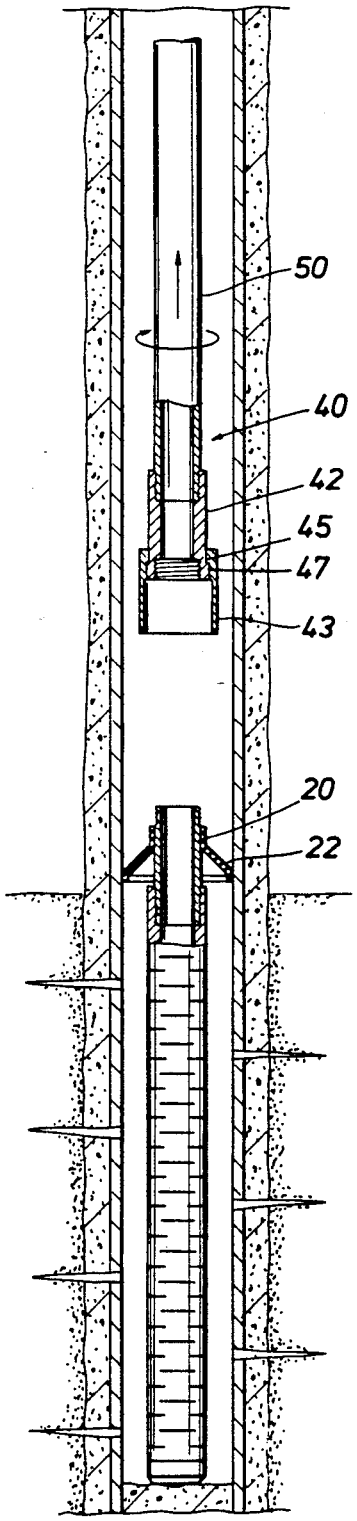
FIG. 2 illustrates the method of the present invention with the running tool and pipe string being withdrawn, permitting the expansion of the elastomeric skirt.
Figure 3:
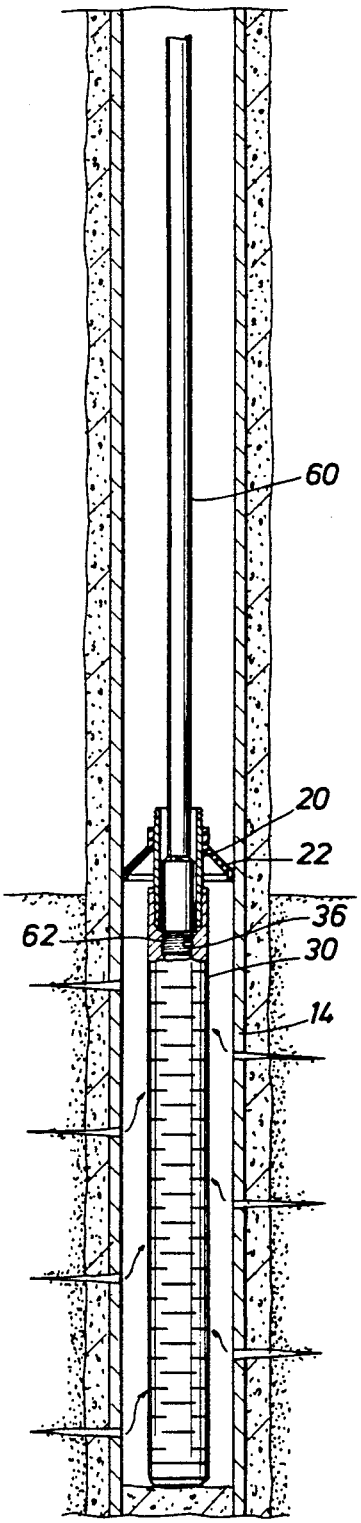
FIG. 3 illustrates the method of the present invention with the production string having been mated with the tubing screen.

FIGS. 1 through 3 illustrate the method of the present invention. A well bore 10 is illustrated as having been drilled to the depth of a water bearing strata 12. Alternately it is understood that the present invention may also be utilized in an oil well environment as well. A casing string 14 has been inserted into the well bore 10 and is secured by means of cement 16 which has been inserted into well bore 10 by known cementing techniques. A perforating gun (not shown) has been previously lowered into the well bore 10 and fired creating a plurality of passageways 18 through the casing 14 and cement 16 into the strata 12. It is further contemplated that the present invention may be utilized in an open-hole well environment, where the strata is of a type which will permit the present invention to seal directly against the walls of the well bore 10.

In FIG. 1 the well bore 10 is shown during a flushing operation. The packer body 20 is mated to the tubing screen 30 and is lowered to the bottom of the well bore 10 at the end of a pipe string 50, which is usually a drill string used in the drilling of the well bore. A running tool 40 is connected to the lower end of pipe string 50.

The running tool 40 illustrated is comprised of a connector body 42 and a sleeve member 43 adapted to fit over and in slidable rotational contact with connector body 42. The packer body 20 may be attached to the tubing screen 30, having a plurality of screen slots 32, by means of threads, welds or other mechanical means. In the preferred embodiment, the packer body 20 is attached to screen 30 by means of right hand threads 28 which mate with right hand threads 34 on the tubing screen 30. Running tool 40 may be connected to packer body 20 by means of retractable dogs, J-slots, or breach mechanisms and is preferably connected by means of left-hand threads 44 on running tool 40 and mating left-hands thread 26 on packer body 20. The running tool connector body 42 is itself mechanically attached to pipe string 50, preferably by means of mating right-hand threads 46 and 52. The sleeve member 43 compresses packer seal skirt 22, permitting the packer 20 and tubing screen 30 to be readily lowered into the well bore 10. In FIG. 1, running water or compressed air, depicted by arrows, is shown flowing down through pipe string 50, through running tool 40 and packer body 20 into tubing screen 30. The water or air passes out of tubing screen 30 through screen slots 32 and returns to the surface through the annulus created between the pipe string 50 and casing 14. This procedure is designed to flush contaminates such as drilling fluids and cuttings (not shown) from the well bore 10.

In FIG. 2, pipe string 50 has been rotated clockwise, disengaging running tool connector body 42 left-hand threads 44 from the mating left-hand threads 26 on packer body 20. As the pipe string is rotated clockwise, the connector body 42 moves in an upward direction bringing connector body 42 external shoulder 47 into contact with sleeve member internal shoulder 45. As sleeve member 43 is in slidable rotational contact with the connector body 42, the sleeve member 43 will not normally be rotated as the pipe string 50 and connector body 42 are rotated clockwise. Thus, the sleeve member 43 will not have to overcome any torsional loading which might be caused by the sleeve member rotating on the seal skirt 22. Further, by retracting longitudinally relative to skirt 22 without rotating, the sleeve member 43 is less likely to damage the skirt 22 as the seal is being activated. The pipe string 50 and running tool 40 are retracted from well bore 10, permitting the packer skirt 22 to expand and engage the inner diameter of the casing 14 to form an annular seal between the skirt 22 and casing 14.

In FIG. 3, a production tubing string 60 adapted to mate with either the packer body 20 or tubing screen 30 is lowered into the well bore 10. A production tubing string 60 having external sealing right-hand threads 62 is lowered into the well bore and is mated with internal sealing right-hand threads 36 in tubing screen 30. Thus, water, as indicated by arrows, enters the well bore 10, through passageways 18, passes into the tubing screen 30 through slots 32 and through the production tubing string 60 to the surface. Water is prevented from reaching the surface through the annulus between the casing 14 and the production tubing string 60 by the expanded skirt 22. Further, the hydrostatic pressure of the water attempting to reach the surface through the annulus has the effect of further expanding the skirt 22, improving the seal that the skirt 22 forms against the internal wall of the casing 14.

FIG. 4 is a detailed view of the present invention the method of which was illustrated in FIGS. 1–3. The seal of the present invention is comprised of a packer body 20. The packer body 20 having an elastomeric skirt 22 affixed to the packer body 20. The skirt 22 is formed from a neoprene plastic or other elastomeric material having a "memory." The term memory is used to describe a characteristic of the elastomeric material such that if the material is deformed from its original molded form, it will tend to return to its original form. The skirt 22 also includes a cylindrical segment 24 which is used to affix packer skirt 22 to packer body 20. The cylindrical portion 24 may be bonded onto packer body 20 by means of adhesive clamps, or other suitable means or, may be directly molded on to packer body 20. The packer body 20 is mated to tubing screen 30 by means of welds, retractable dogs, J-slots, threads or other suitable mechanical water tight means. In the illustrated embodiment, packer body 20 includes a set of right hand male threads 28 which are designed to mate and seal with female threads 32 in tubing screen 30. The packer body 20, skirt 22 and tubing screen 30 are lowered to the bottom of the well board 10 by means of running tool 40. In the illustrated embodiment, the running tool is comprised of two parts, a connector body 42 and a sleeve member 43. The connector body 42 is adapted to mate with packer body 20 by means of left hand threads, retractable dogs, J-slots, breach-lock or other common mechanical means. In the illustrated embodiment, the connector body 42 has left hand female internal threads 44 adapted to mate with a left hand male threads 26 on packer body 20. Thus, the connector body 42 may be disconnected from the packer body 20 by disengaging the left hand threads without disturbing the connection made between the packer body 20 right hand threads 28 and the tubing screen 30 right hand threads 32. The sleeve member 43 of running tool 40 is adapted to fit over connector body 42 of running tool 40 and is in slidable and rotational contact with connector body 42. The packer body 20 and the connect body 42 of running tool 40 are mated at the surface and the sleeve member 43 of running tool 40 is then moved forward to collapse skirt 22 to permit insertion of the packer body 20 into the well bore. Sleeve member 43 has an internal shoulder 45 which contact with an external shoulder 47 of connector body 42 of running tool 40. The running tool 40 is mated with a pipe string 50 by means of mating right hand threads 46 and 52. The assembly including the tubing screen 30, packer body 20 and skirt 22 and running tool 40 is then lowered to the bottom of well bore 10 by means of drilling string 50. FIG. 5 illustrates a preferred embodiment of the present invention with the seal activated. After having been lowered to the bottom of the well board 10, pipe string 50 is rotated in a clockwise direction causing left hand threads 26 on packer body 20 and left hand threads 44 on connector body 42 of running tool 40 to disengage. As the mating threads 26 and 44 disengage, connector body 42 of running tool 40 is withdrawn in the direction of the surface. As running tool 40 moves toward the surface, the external shoulder 47 of connector body 42 of running tool 40 comes into contact with the internal shoulder 45 of sleeve member 43 of running tool 40 causing the sleeve member 43 to retract linearly toward the surface. As a result, the skirt portion of 43 of running tool 40 releases the collapsed skirt 22 from permitting the collapsed skirt to expand to its memory position and seal off against the internal wall of casing 14. Because the sleeve member 43 is in slidable rotational contact with connector body 42, the sleeve member 43 of running tool 40 does not rotate but is retracted in a linear manner. This decreases the amount of force required to retract the sleeve member 43 from skirt 22. Further, the sleeve member is less likely to damage the skirt 22 when retracted in a linear manner. Thus, it is less likely that the seal quality will be compromised during installation. Further, the seal formed by skirt 22 and internal wall of casing 14 is improved as a result of hydrostatic pressure, as shown by arrows in FIG. 3, forcing the skirt 22 further out against the internal wall of casing 14.

FIG. 6 is an alternative embodiment of the present invention illustrating a single piece running tool 70. The running tool 70 has a central bore 71 and a larger counter bore 72 which collapses skirt 22 when running tool 70 mated with packer body 20. The central bore 71 has left hand internal threads 73 adapted to mate with left hand external threads 26 of packer body 20. The central bore also has internal right hand threads 74 adapted to mate with external right hand threads 52 of pipe string 50. The central bore 71 has a thread relief grove 76 to permit both right hand threads 74 and left hand threads 73 to be machined in the central bore 71. The well seal is activated in a similar manner as shown in FIGS. 2 and 5. The pipe string 50 is rotated in a clockwise direction disengaging threads 26 and 73 causing the running tool 70 to move towards the surface. As the running tool mates towards the surface the skirt 22 is released by the packer body 70.

The running tool 70 described in FIG. 6 has the disadvantage of having to overcome the resistance between the internal bore 72 and the skirt 22 as the pipe string 50 is being rotated clockwise. However, the running tool 70 described in FIG. 6 may be used to recover the packer body 20, skirt 22 and tubing screen 30 and withdraw them from the well. The production tubing 80, as shown in FIG. 3 is disconnected from the tubing screen 30. The running tool 70 is then lowered at the end of a pipe string 50. The pipe string 50 is rotated counterclockwise bringing the left-hand threads left-hand threads 73 into engagement with the left-hand threads 26 of packer body 20. As the threads engage, the internal bore 72 of running tool is rotates and moves forward over skirt 22, thus collapsing skirt 22 and permitting the packer body 20, skirt 22 and tubing screen 30 to be withdrawn.

The description given here is intended to illustrate the preferred embodiment of this invention. It is possible to make various changes to the details of the apparatus or method without departing from this invention. It is intended that all such variations be included within the following claims.

I claim:

1. A method for providing a seal in a well pipe, the steps comprising:

releasably connecting a running tool, said running tool having an upper end a having right hand thread and a lower end having a left hand thread, at its upper end to a pipe string;

releasably connecting a packer body to said lower end of said running tool, said packer body having an upper end having left hand threads adapted to mate with said left hand threads on said lower end of said running tool, and a lower end, said lower end of said packer body having an elastomeric seal skirt disposed about said packer body lower end, said lower end of said running tool collapsing said elastomeric seal skirt;

lowering said packer body, said running tool and said seal skirt into a well pipe to a predetermined depth; and releasing said running tool from said packer body, said seal skirt expanding into sealing contact with the well pipe.

2. The method of claim 1, wherein the step of releasing said running tool from said packer body includes the step of rotating the pipe string counterclockwise to disengage said left hand threads on said packer body and running tool.

3. An annular well sealing apparatus for use in the production of fluid in a well bore having a well pipe therein comprising:

a packer body adapted to be positioned in a well bore with a fluid screen therebelow;

a resilient seal skirt, said seal skirt being mounted on said packer body and adapted to expand from a first collapsed position out of contact with the internal wall of the well pipe to a second sealing position in sealing contact with the internal wall of the pipe, where said sealing skirt is disposed in a downwardly flaring frustro-conical form; and a running tool, said running tool comprising a connector body, said connector body having an upper and a lower end, said connector body having means for releasably connecting said upper end of said connector body to a pipe string, said connector body further having means for releasably connecting said connector body to said packer body;

a sleeve member adapted to fit over and in slidable rotatable contact with said connector body, said sleeve member further having a first position, wherein said sleeve member is adapted to fit over said seal skirt, placing said seal skirt in its collapsed position and a second retracted position thereby permitting said seal skirt to expand into sealing position against the internal wall of the well pipe; and means for moving said sleeve member from said first position to said second position.

4. The sealing apparatus of claim 3, wherein the means of releasably connecting said connector body to a pipe string includes right hand threads on said upper end of said connector body adapted to mate with right hand threads on the lower end of the pipe string.

5. The sealing apparatus of claim 3, wherein the means of releasably connecting said connector body to said packer body includes left hand threads on said lower end of said connector body adapted to mate with left hand threads on the upper end of said packer body.

6. The sealing apparatus of claim 3, wherein said seal skirt is molded from a resilient elastomeric material in downwardly flaring frustro-conical form, said elastomeric material having characteristics which return said skirt to its molded form after said running tool is removed, the well bore pressure further expanding said seal skirt thereby improving sealing contact between said seal skirt and the internal wall of the well pipe.

* * * * *